US006471083B1

(12) United States Patent
Helms

(10) Patent No.: US 6,471,083 B1
(45) Date of Patent: Oct. 29, 2002

(54) INDUCTION-SEALED COMPOSITE CONTAINER END CLOSURE

(75) Inventor: Charles R. Helms, Malvern, PA (US)

(73) Assignee: Double "H" Plastics, Inc., Warminster, PA (US)

( * ) Notice: Subject to any disclaimer, the term of this patent is extended or adjusted under 35 U.S.C. 154(b) by 4 days.

(21) Appl. No.: 09/693,792

(22) Filed: Oct. 20, 2000

Related U.S. Application Data

(60) Provisional application No. 60/160,457, filed on Oct. 21, 1999.

(51) Int. Cl.[7] ..... B65D 41/32; B65D 43/16; B65D 17/34

(52) U.S. Cl. ..... 220/259.1; 220/254.3; 220/256.1; 220/359.2; 220/359.3; 220/359.4; 220/836; 229/123.1; 229/123.3; 229/125.08; 229/125.09; 229/125.35

(58) Field of Search ..... 220/256, 213, 220/254, 287, 305, 810, 836, 837, 839, 801, 805, 359.1, 359.2, 359.3, 359.4, 359.5, 256.1, 259.1, 254.3, 254.1; 229/5.5, 123.1, 125.05, 125.09, 247, 123.2, 123.3, 245, 125.01, 125.08, 125.33, 125.35

(56) References Cited

U.S. PATENT DOCUMENTS

| | | | | |
|---|---|---|---|---|
| 2,893,456 A | | 7/1959 | Wallace | |
| 2,970,736 A | * | 2/1961 | Baughan | 229/123.1 |
| 3,892,351 A | | 7/1975 | Johnson et al. | |
| 3,899,079 A | | 8/1975 | Seiter | |
| 3,934,749 A | | 1/1976 | Andrulionis | |
| 4,044,941 A | | 8/1977 | Knudesen | |
| 4,094,460 A | | 6/1978 | Scanga et al. | |
| 4,401,231 A | | 8/1983 | Helms | |
| 4,418,834 A | | 12/1983 | Helms et al. | |
| 4,442,971 A | | 4/1984 | Helms | |
| 4,448,345 A | | 5/1984 | Helms | |
| 4,453,666 A | * | 6/1984 | Gordon | 229/102 |
| 4,650,088 A | * | 3/1987 | Hirota et al. | 220/270 |
| 4,673,126 A | * | 6/1987 | Hambleton | 229/123.1 |
| 4,692,132 A | | 9/1987 | Ikushima et al. | |
| 4,768,703 A | | 9/1988 | Sosler et al. | |
| 5,979,748 A | | 11/1999 | Drummond et al. | |
| 6,145,689 A | * | 11/2000 | Kobayashi et al. | 220/359.2 X |

* cited by examiner

*Primary Examiner*—Lee Young
*Assistant Examiner*—Niki M. Eloshway
(74) *Attorney, Agent, or Firm*—Synnestvedt & Lechner LLP

(57) ABSTRACT

A closure for sealing an opening of a tubular container is disclosed, the closure having a paperboard central panel with a plurality of secondary panels extending angularly therefrom forming a surface around the perimeter of the central panel. A plastic skirt is adhered around the perimeter of the central panel and to one side of the secondary panels opposite the surface to reinforce it. A metal foil layer is adhered to the surface, the foil having a side facing the sidewall of the container with a heat-activated adhesive layer thereon. The closure is positioned on the container with the central panel in registration with the opening and the heat-activated adhesive layer engaging the sidewall of the container. The seal between the closure and the container is effected by subjecting the container to an electromagnetic induction field, whereby eddy currents induced in the metal foil by the field cause the heat-activated adhesive to form a bond between the container sidewall and the secondary panels.

20 Claims, 13 Drawing Sheets

20
24
28
40
42
7
10
52
112
10
46
50
56
96
54
22
22b
60
98
7
44
102
48
38
3
26
22a
64
3
34
24
36
30
32

60
54
44
48
58
38
56
20
22
40
52
50
46

20
22
88
26
84
86

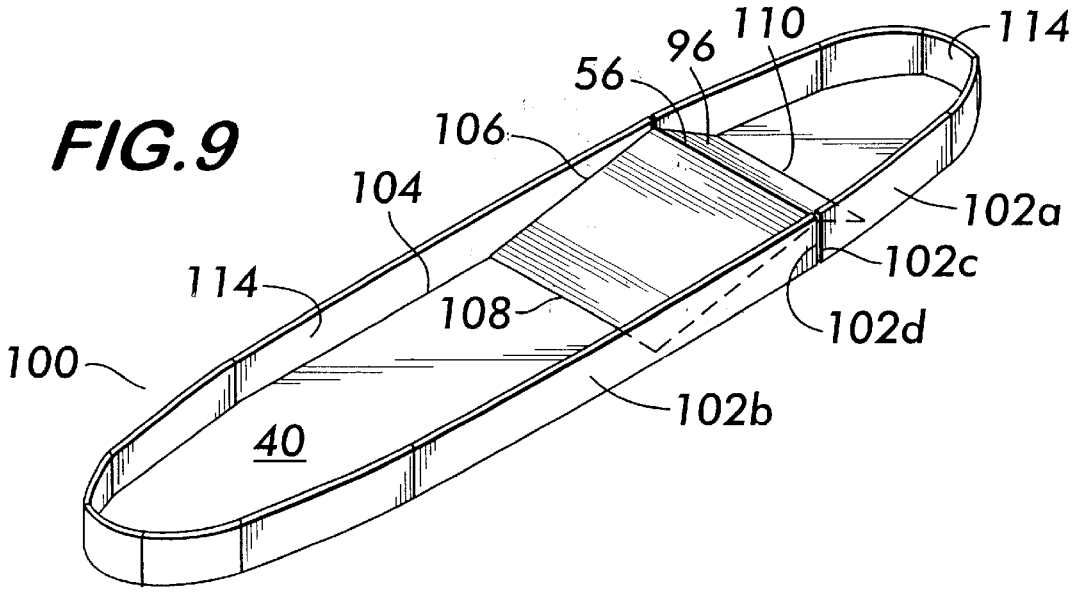
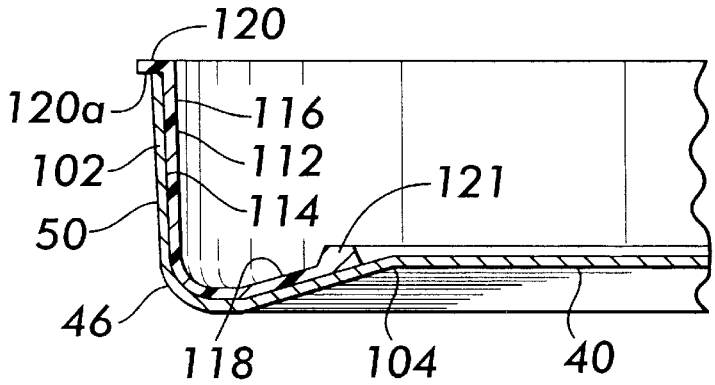
FIG.10
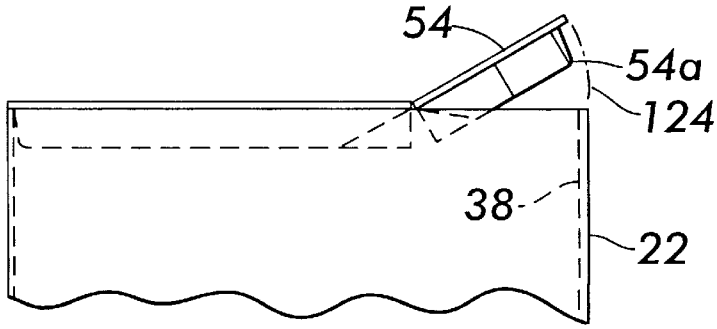
FIG.11
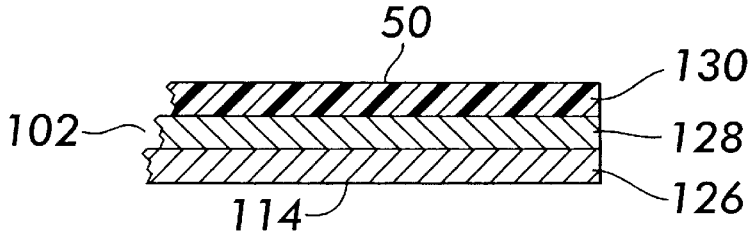
FIG.12

FIG.13
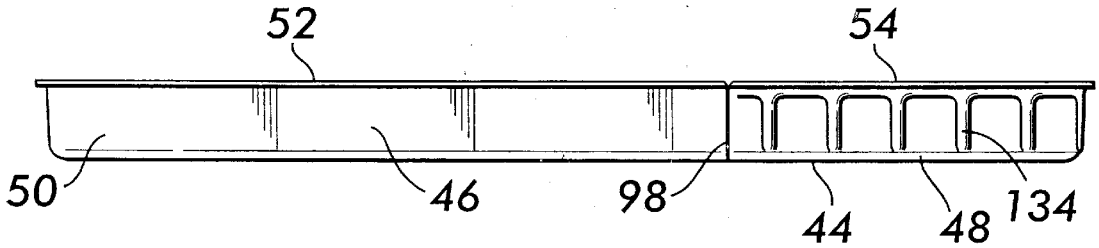
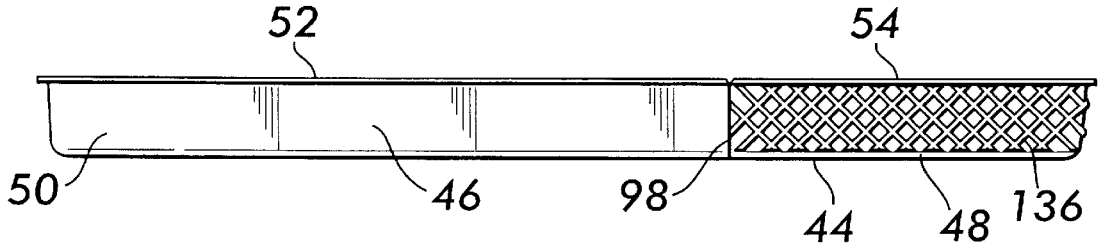
FIG.14
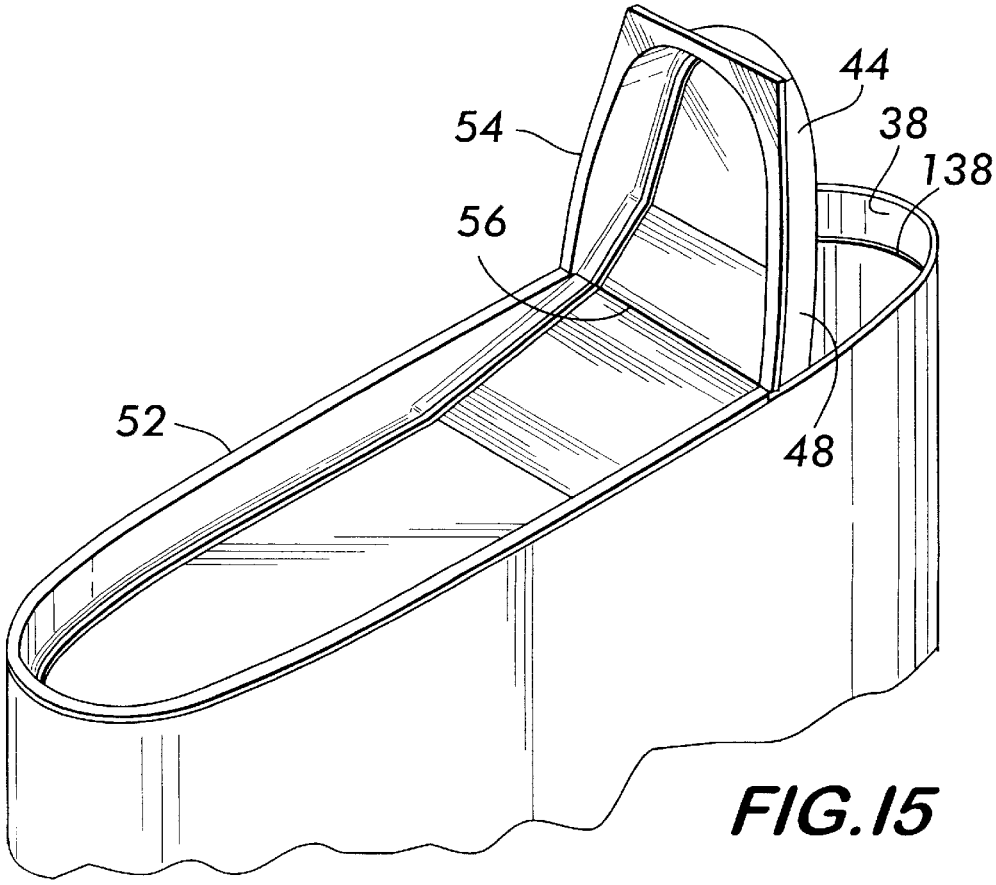
FIG.15

FIG.16
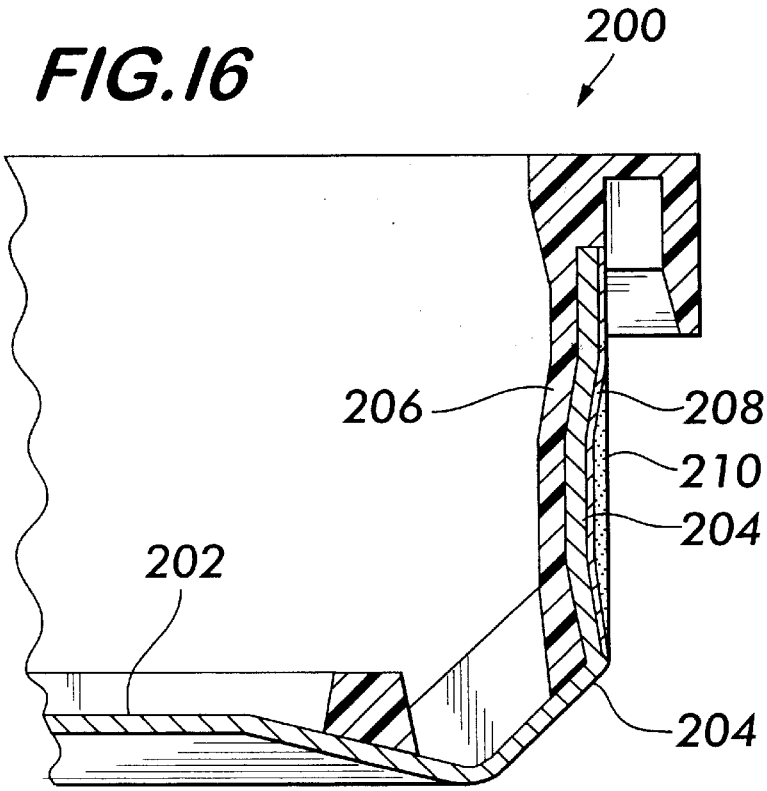
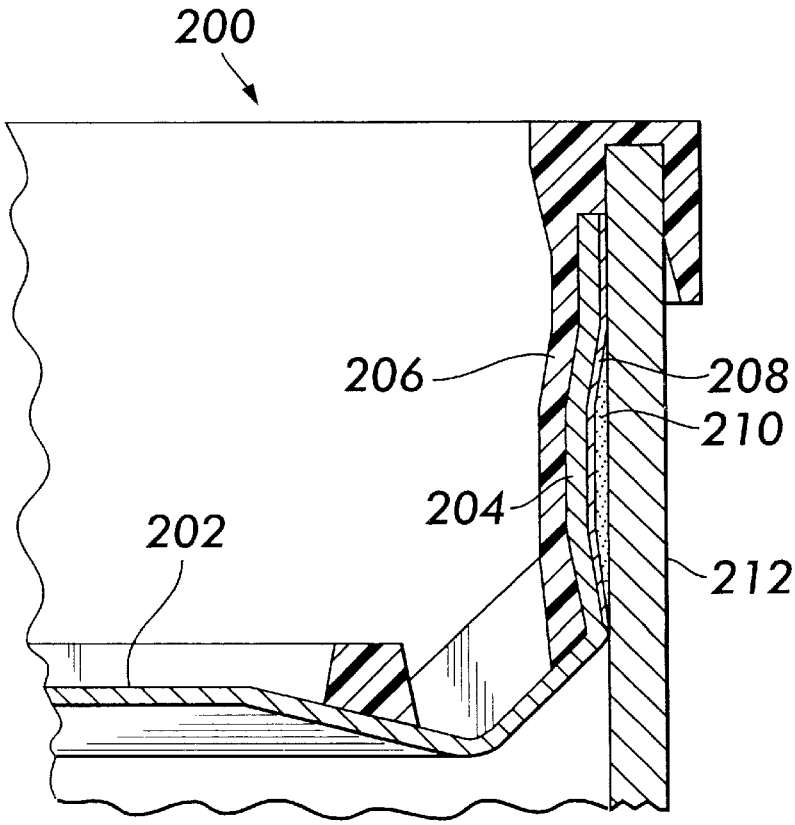
FIG.17

INDUCTION-SEALED COMPOSITE CONTAINER END CLOSURE

RELATED APPLICATION

This application is based on and claims the benefit of prior filed Provisional Application No. 60/160,457, filed Oct. 21, 1999, abandoned.

FIELD OF INVENTION

This invention relates to container end closures such as tops or bottoms made of a combination of paperboard and plastic materials, and especially to tops and bottoms used with tubular containers.

BACKGROUND OF THE INVENTION

Tubular containers find use throughout the packaging industry and provide a robust container useful in a broad range of applications to hold a wide variety of bulk goods including foodstuffs, hardware and chemicals to cite only a few examples.

Tubular containers typically comprise three separate components, the tube forming the sidewalls of the container, a top for sealing one end of the tube and a bottom for sealing the opposite end. Separate components for one or both closures are often used primarily because it is not practical to integrally form a top or bottom with the tube. This is especially true if an air-tight seal is required or flat bottoms and tops are desired to allow the tube to stand upright or stack atop another tube.

Having three components complicates the process of filling and sealing tubular containers and increases their unit cost in comparison with, for example, box containers wherein the tops and bottoms are integral with the container sidewalls.

Tubular containers require that separate bottoms and tops be supplied and somehow be attached and sealed to the tubular sidewall. Liquid hot-melt adhesives provide an effective attachment and sealing means, but they add a further expense to the processing in the form of adhesive costs and capital investment in machinery required to handle and apply the adhesive to the tops and bottoms. The cost increase per container incurred by the use of liquid hot-melt adhesives to form tubular containers is unacceptable to many manufacturers and makes tubular containers uncompetitive with other types of containers. A further disadvantage associated with liquid hot-melt adhesives is the potential for contamination of the container contents when the liquid is applied to attach and seal the top or bottom to the container.

Another disadvantage of tubular containers sealed by hot-melt adhesives becomes apparent after the container is filled with product and the second closure, be it the bottom or the top, is to be attached and sealed closed. Machinery which may come into contact with the product must be built to withstand product spillage, must not contaminate the product, and must not cause dangerous conditions, for example, cause open sparks in the presence of fine powders which could lead to an explosion. (Machines which handle foodstuffs are built to especially rigorous standards imposed by the FDA.) These requirements lead to machines which are considerably more expensive than machinery which must merely form the container and attach a closure to one end. It is, therefore, highly desirable to physically separate the machine which attaches and seals the second closure to the filled container from the machine which forms the container. It is also advantageous to make the machine which seals the closure to the container as simple as possible, preferably, impervious to the product and easily serviced and cleaned in the event of an accident. This is not generally possible when liquid hot-melt adhesives are used.

There is clearly a need for tubular container closures which are attachable and sealable without using liquid hot-melt adhesives and by relatively simple machinery which is impervious to spillage and will not contaminate the product.

SUMMARY AND OBJECTS OF THE INVENTION

The invention concerns both a closure for a container as described and claimed herein and a container having such a closure.

The container, preferably a spiral wound tubular type, has a sidewall defining an interior and an end opening. The preferred embodiment of the closure comprises a central panel positionable in registration with the opening. The central panel has a perimeter substantially conforming to the container sidewall. At least one secondary panel extends angularly from the perimeter of the central panel and forms a surface around the closure substantially parallel to and facing the sidewall of the container. A metal foil layer is adhered to the surface formed by the secondary panel. The metal foil layer has a side facing the sidewall on which a heat-activated adhesive layer is positioned. The adhesive layer is engageable with the sidewall, and the metal foil layer is heatable by electromagnetic induction to melt the heat-activated adhesive layer and form an adhesive bond between the secondary panel and the sidewall when the secondary panel and the sidewall are in interfacing relationship.

Preferably, the surface formed by the secondary panel faces outwardly from the central panel and engages the container sidewall within the interior of the container, the closure interfitting within the container like a plug. Preferably, the closure also comprises a plastic skirt extending around the perimeter of the central panel. The skirt has an upper leg adhered to the central panel and a lower leg adhered to the secondary panel on a side opposite to the heat-activated adhesive layer.

In the preferred embodiment, the sidewall, central panel and the secondary panel all comprise paperboard, the metal foil layer comprises aluminum, and the heat-activated adhesive layer comprises a plastic resin.

When the closure is being used as a top for the container, a first portion of the secondary panel surface is preferably removably attached to the sidewall, and a second portion of the surface is fixedly attached to the sidewall. The adhesive bond between the first surface portion and the sidewall is a relatively weaker bond than the adhesive bond between the second surface portion and the sidewall. This allows the first surface portion to define a movable part of the closure which is relatively easily separable from engagement with the sidewall and movable with respect to the container. The second surface portion defines a fixed part of the closure intended to be permanently attached to the sidewall. A hinge is positioned on the central panel between the fixed and movable parts of the closure. When the closure is positioned in registration with the opening, the movable part is pivotable on the hinge relatively to the fixed part into a position away from the opening to expose the opening and allow access to the contents of the container.

The relatively weaker bond associated with the first surface portion may be formed by positioning an adhesive release agent at an interface between the first surface portion and the container sidewall. Preferably, the adhesive release agent is positioned at the interface between the adhesive layer and the foil layer, although other interfaces, such as between the aluminum foil and the secondary panel, are also feasible. The weaker bond may also be formed by incorporating a raised region of reduced surface area on the first surface portion. The raised region projects above the surface of the secondary panel toward the sidewall and has a surface area comprising a fraction of the surface area of the first surface portion. The relatively weaker adhesive bond is caused by the reduced surface area interface between the first surface portion and the sidewall and is formed between the foil layer covering the raised region and the sidewall.

In an alternate embodiment, the closure comprises a removable lid having a central surface in overlying relation with the central panel of the closure. The removable lid has a perimetral flange extending angularly outwardly from its central surface around the lid, the flange conforming substantially to the plastic skirt. The skirt has a rim positioned surrounding the closure, the rim defining a shoulder extending inwardly toward the lid and engaging the perimetral flange substantially around the lid for removably retaining the lid to the closure.

The invention also concerns a method of manufacturing a closure sealable to a container by electromagnetic induction. The method comprises the steps of providing a substrate layer having a layer of metal foil adhered to one side thereof and a heat-activated adhesive adhered to the metal foil layer opposite said substrate layer. Preferably, the substrate layer is paperboard, the metal foil is aluminum and the adhesive is a plastic resin. Another step of the method includes forming from the substrate layer a central panel having a perimeter and at least one secondary panel extending from the perimeter. The central panel is designed to fit in registration with an opening of the container. In a further step, the secondary panel is angularly oriented with respect to said central panel and an elastic skirt is formed around the perimeter of the central panel, the skirt having at least one leg positioned on a side of the secondary panel opposite to the metal foil layer. The orienting and forming steps are preferably done in a core and cavity mold, and the skirt is formed from a plastic resin via injection molding using the aforementioned mold. Preferably, the central and secondary panels are formed by die cutting the substrate layer.

It is an object of the invention to provide a closure for a tubular container.

It is another object of the invention to provide a closure for a tubular container attachable to the container without the use of liquid hot-melt adhesives during filling and assembly of the container.

It is yet another object of the invention to provide a closure attachable to a sidewall of a container by means of induction heating.

It is still another object of the invention to provide a closure having a fixed portion and a movable portion for forming a hinging lid for the container.

These and other objects of the invention will become apparent from a consideration of the drawings and detailed description of the preferred embodiment.

BRIEF DESCRIPTION OF THE DRAWINGS

FIG. 9 is a perspective view of the unitary blank shown in FIG. 8 after the blank has been cut and folded;

FIG. 10 is a cross-sectional view on an enlarged scale taken along line 10—10 of FIG. 1;

FIG. 11 is a partial side view of the container shown in FIG. 1;

FIG. 12 is a cross-sectional view taken along line 12—12 of FIG. 8;

FIG. 13 is a side view of an embodiment of a container top according to the invention;

FIG. 14 is a side view of another embodiment of a container top according to the invention;

FIG. 15 is a partial rear perspective view of a container having an embodiment of a top according to the invention;

FIG. 16 is a partial sectional view of an alternate embodiment of a container top according to the invention;

FIG. 17 is a partial sectional view of the container top shown in FIG. 16 in a closed position on a container;

DETAILED DESCRIPTION OF THE PREFERRED EMBODIMENT

Figure 1:
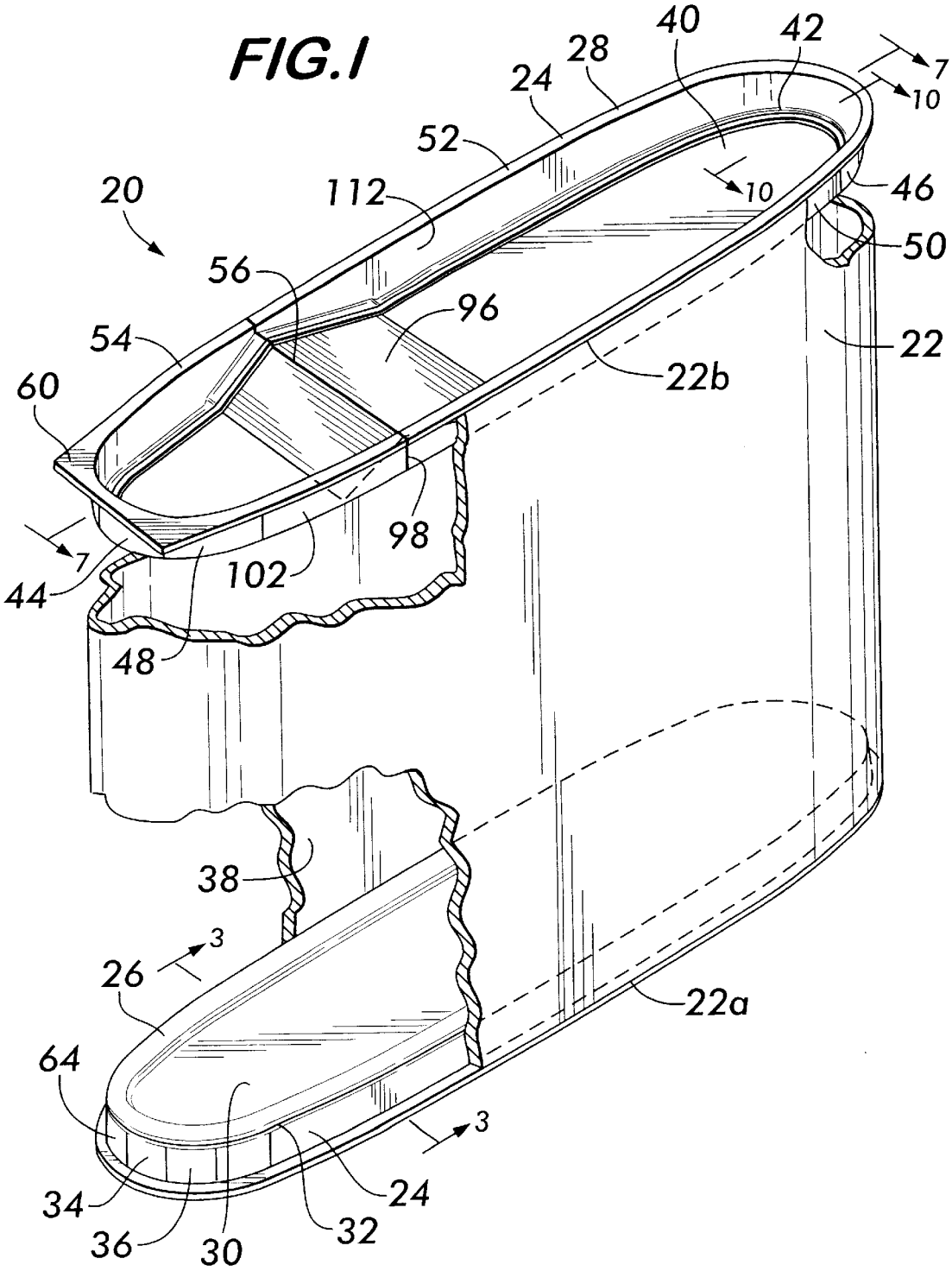
FIG. 1 is a partial cut-away front perspective view of a container having closures according to the invention.

FIG. 1 shows a tubular container 20 having a sidewall 22 and two end closures 24, one forming a bottom 26 and the other forming a top 28.

Bottom 26 comprises a central panel 30 having a perimeter 32 and a rim 34 extending substantially continuously around the perimeter 32. Rim 34 is oriented at an angle to panel 30 and provides an outwardly facing surface 36 attachable to the inside surface 38 of sidewall 22.

Top 28 is similar in construction to bottom 26, the top comprising a central panel 40 having a perimeter 42 about which two rim segments 44 and 46 extend end to end to continuously surround the perimeter. Rim segments 44 and 46 are oriented at an angle to the central panel 40 and provide respective outwardly facing surfaces 48 and 50 attachable to the inside surface 38 of sidewall 22.

Figure 2:
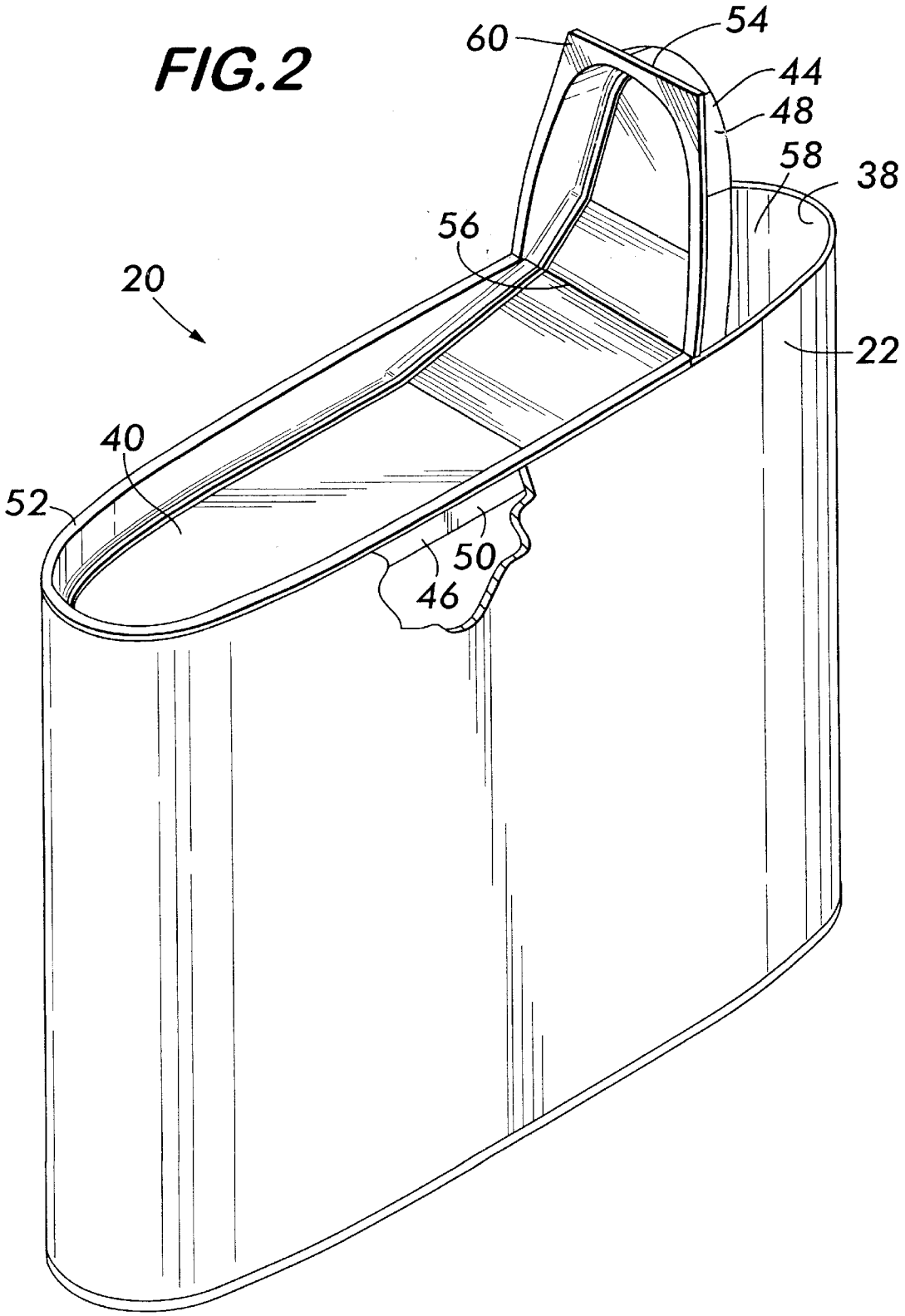
FIG. 2 is a rear perspective view of the container shown in FIG. 1.

Top 28 is divided into a fixed part 52 and a movable part 54 preferably hingedly attached to the fixed part by means of hinge 56 disposed between the two parts. Fixed part 52 includes rim segment 46 and remains permanently attached to sidewall 22, whereas movable part 54 includes rim segment 44 and is separably attached to the sidewall (as described in detail below) and can be separated from sidewall 22 by the application of a predetermined force and rotated outwardly from the container to provide a dispensing opening 58, as seen in FIG. 2. Movable part 54 has lifting tabs 60 which extend outwardly from the top opposite hinge 56 to provide purchase for manual opening of the top. Dispensing opening 58 can be reclosed by rotating movable part 54 back into interengagement with sidewall 22.

Detailed Description of the Bottom

Figure 3:
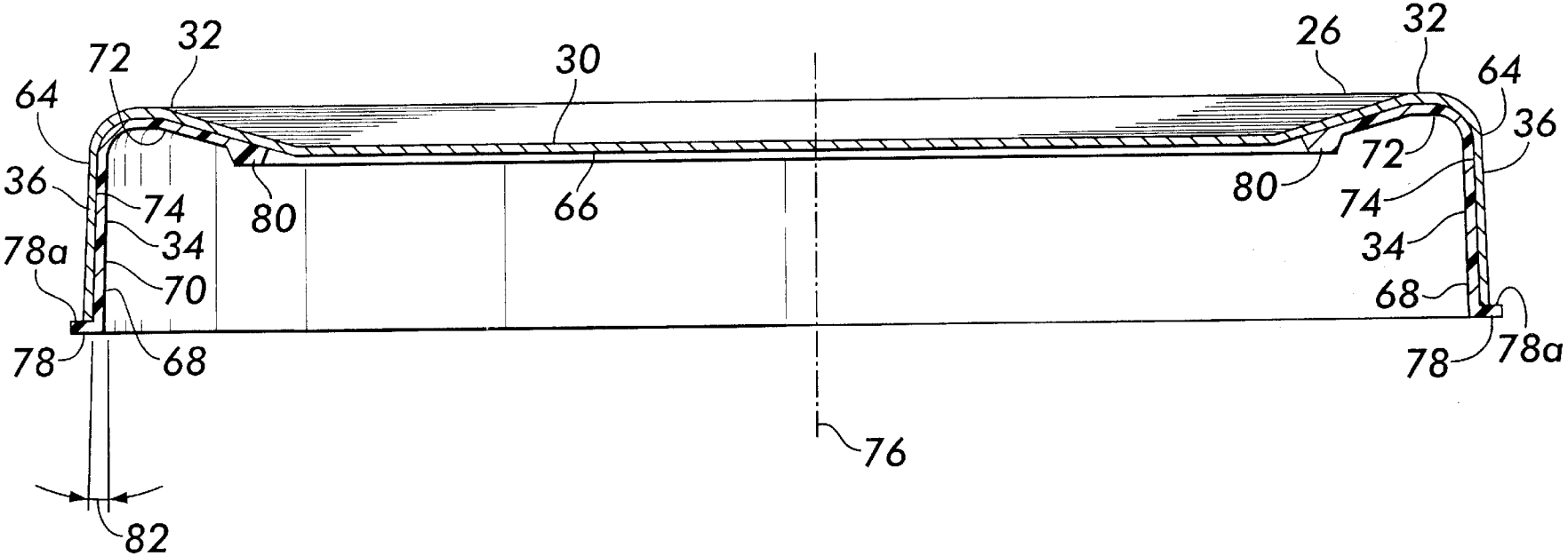
FIG. 3 is a cross-sectional view of the container bottom on an enlarged scale taken along line 3—3 of FIG. 1.
Figure 4:
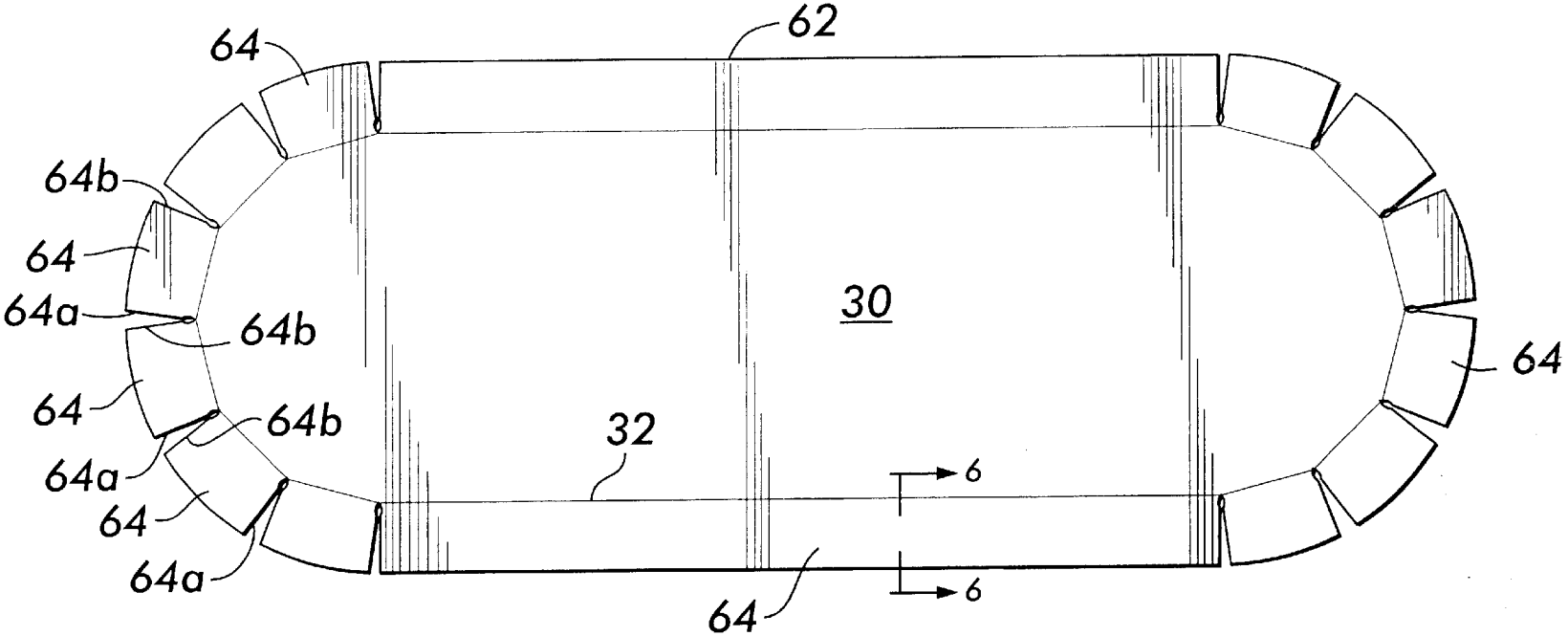
FIG. 4 is a plan view of a unitary blank forming part of the container bottom shown in FIG. 1.

FIG. 3 is a cross-sectional view of bottom 26 showing central panel 30 and rim 34. Central panel 30 is preferably formed from a unitary blank 62 of paperboard laminate shown in FIG. 4. Central panel 30 has a plurality of secondary panels 64 extending from it at the perimeter 32. In forming the bottom, the secondary panels are folded to one side 66 of the central panel 30 to form the rim 34 (see FIG. 3). The secondary panels 64 are formed with opposite edges 64*a* and 64*b* angularly displaced from adjacent edges 64*b*, 64*a* respectively, of neighboring secondary panels 64, as seen in FIG. 4. Angularly displaced edges 64*a* and 64*b* allow the secondary panels 64 to be in edge abutting relationship when folded and, thereby, form a substantially continuous rim 34, as shown in FIG. 1.

As seen in FIG. 3, rim 34 also comprises a skirt 68 preferably formed from a plastic resin in an injection molding process described below. Plastics such as polypropylene, polyethylene and polystyrene are used because they provide a relatively stiff, resilient skirt which is impervious to harsh environments such as moisture or cold. Skirt 68 preferably comprises a lower leg 70 and an upper leg 72 and extends substantially continuously around the bottom 26.

Lower leg 70 is adhered to secondary panels 64 on a surface 74 facing the center of bottom 26, that center being defined by the axis 76 oriented perpendicularly to central panel 30. The free end of lower leg 70 has a flange 78 extending outwardly at an angle from the leg, the flange stiffening the skirt and providing a shoulder 78*a* against which an edge 22*a* of sidewall 22 may abut to limit the travel of the bottom 26 into the container 20 when the bottom is installed (see FIG. 1).

As further shown in FIG. 3, upper leg 72 is adhered to the central panel 30 in the region of its perimeter 32 and serves to stiffen and reinforce the central panel and provide structural integrity to the connection between the panel and the skirt. The free end of upper leg 72 comprises a bar 80 having a substantial cross-sectional area for stiffening the bottom where the central panel 30 attaches to the skirt 68.

Preferably, bottom 26 is formed in an injection molding process using a mold comprising interfitting core and cavity mold portions. Blank 62 is placed within the cavity portion and the secondary panels are folded as indicated in FIG. 3 when the core portion interengages the cavity portion. Together, the core and cavity portions form a void defining the shape of the skirt. Liquid plastic resin is injected into the void, the plastic adhering to surfaces 74 of secondary panels 64 and to side 66 of central panel 30 to form the skirt 68. The resin is cured, and the bottom is removed from the mold.

The skirt is adhered to the blank by preparing surfaces 74 and side 66 to be compatible with the resin. For example, if polystyrene is used for the skirt, it will adhere naturally to paperboard. If polyethylene is used, then the surfaces 74 and side 66 are prepared by coating them with polyethylene or another plastic coating which will fuse with the molten resin upon injection and cause the skirt and panels to adhere upon curing.

As seen in FIG. 1, bottom 26 is inserted into the container like a plug with the outwardly facing attachment surface 36 of rim 34 in contact with the inside surface 38 of sidewall 22. It is advantageous to angle the rim outwardly toward the free edge of the lower leg through an angle 82, as seen in FIG. 3. This provides a tapered shape to the bottom which permits it to easily interfit within the container and engage the container sidewall with a wedging action providing continuous contact pressure between the rim and the container circumferentially around the bottom for a strong attachment and a good seal.

As previously mentioned, liquid hot-melt adhesives can be used to attach a bottom to a tubular container sidewall, but this method of attachment is expensive, requires additional machinery to apply the liquid adhesive and presents the risk of adhesive contamination of the container contents. Applicant's method of attachment is by means of inductive heating of the bottom as described below.

Figure 5:
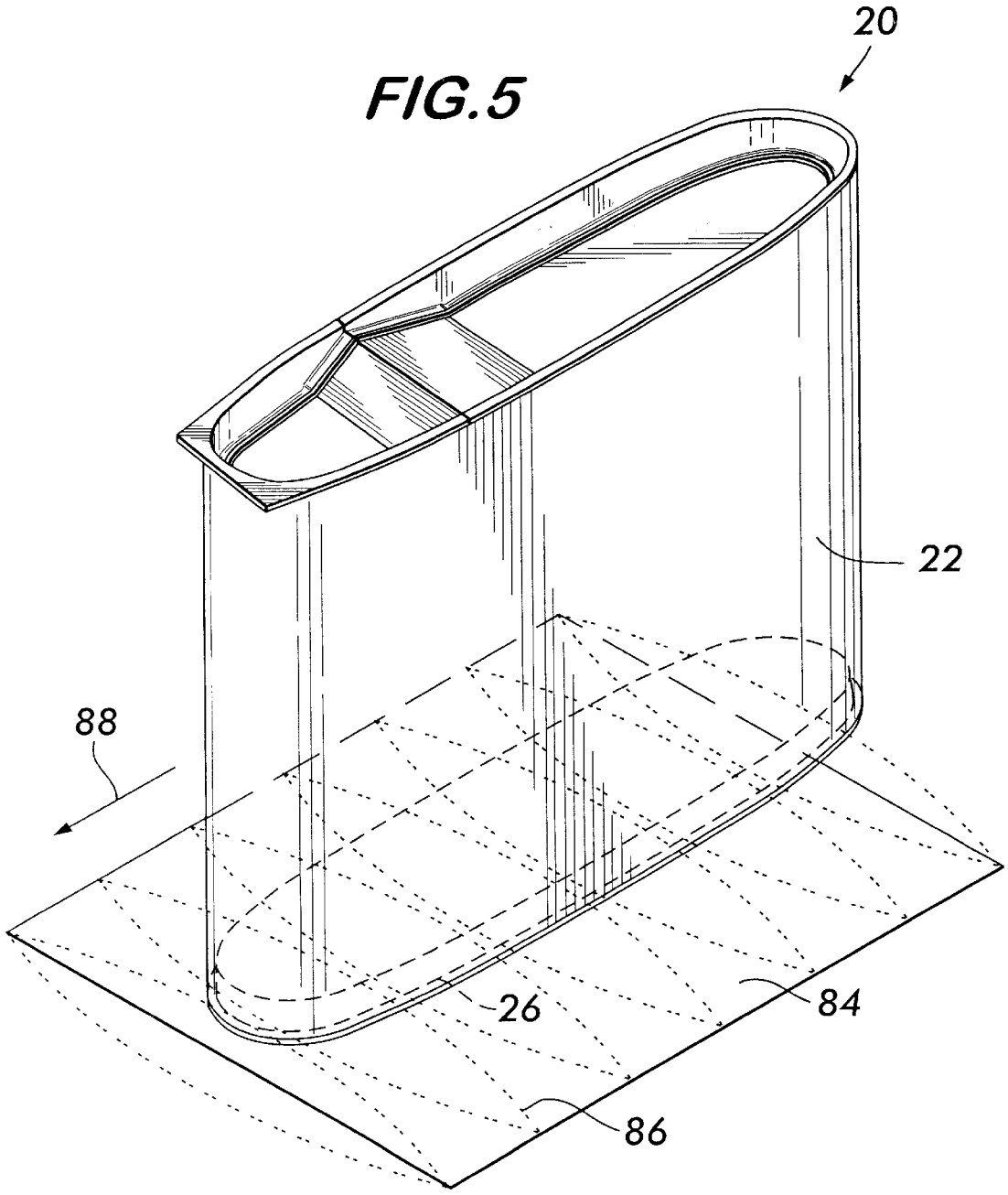
FIG. 5 is a perspective view of a container being sealed by an inductive sealing device.

FIG. 5 shows container 20 having its bottom 26 sealed to its sidewall 22 by means of an inductive unit 84, shown only schematically. Electrical currents in conductors in the unit 84 form electromagnetic fields 86 which induce eddy currents in any conductor present in the field, heating the conductor. By incorporating heat-activated adhesive and an electrical conductor in the bottom 26, the adhesive can be heated when the container is passed through the electromagnetic fields 86 as shown by the arrow 88 to heat fuse and seal the bottom to the sidewall.

Figure 6:
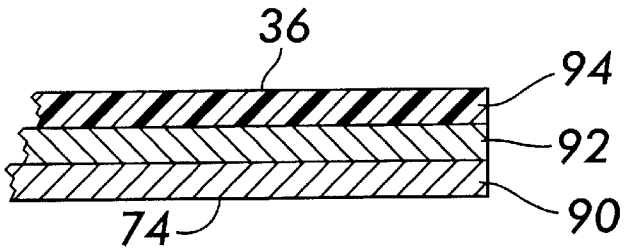
FIG. 6 is a cross-sectional view on an enlarged scale taken along line 6—6 of the blank shown in FIG. 4.

FIG. 6 shows a preferred configuration for the secondary panels 64 which incorporate an electrical conductor allowing inductive sealing of the bottom 26. The secondary panels are formed of a laminate comprising a paperboard layer 90, a metal foil layer 92 and a plastic resin layer 94 forming the outwardly facing attachment surface 36. Aluminum is preferable for the foil layer because it is inexpensive and easy to apply to the paperboard. The plastic resin layer comprises one of a number of common plastics such as polystyrene, polyethylene and polypropylene to cite some examples and serves as a heat-activated adhesive.

As seen in FIG. 1, surface 36 faces outwardly from bottom 26 toward the inside surface 38 of sidewall 22. In the region of contact, inside surface 38 is treated to be compatible with the plastic resin layer 94 such that when the resin layer is heated to its melting point it will fuse with the inside surface 38 to adhere the bottom 26 to the sidewall 22 and form a substantially continuous seal between the two around the circumference of the container. The foil layer 92 heats the resin layer when eddy currents are induced in the metal foil layer as the container passes through the fields 86 generated by the inductive unit 84. Eddy currents cause the foil to heat up which melts the contiguous plastic resin coating 94 which then adheres to both the foil 92 and the inside surface 38 of sidewall 22.

Inductive heating is preferred because it does not require that an apparatus contact the surfaces to be fused. The surfaces must merely be within the electromagnetic field of an induction coil for a specific length of time sufficient to melt the resin layer and form the seal between surfaces 36 and 38. Additionally, inductive units tend to be sealed and are, thus, impervious to the products held within the containers, so if there is a spill, the unit will not be adversely affected and the spill can be cleaned up easily. Use of the inductive heating unit to seal the container helps realize the aforementioned advantage by separating the machinery which seals the filled container from the machinery which forms the container before filling.

Inside surface 38 can be made compatible to fuse with resin layer 94 in a number of different ways. For example, if resin layer 94 comprises polystyrene, it will adhere directly to paper when heated. If the resin layer is polyethylene, then it is preferable to coat the inside surface 38 with a polyethylene layer which will fuse with layer 94 when the metal foil layer 92 is heated.

Detailed Description of the Top

Figure 7:
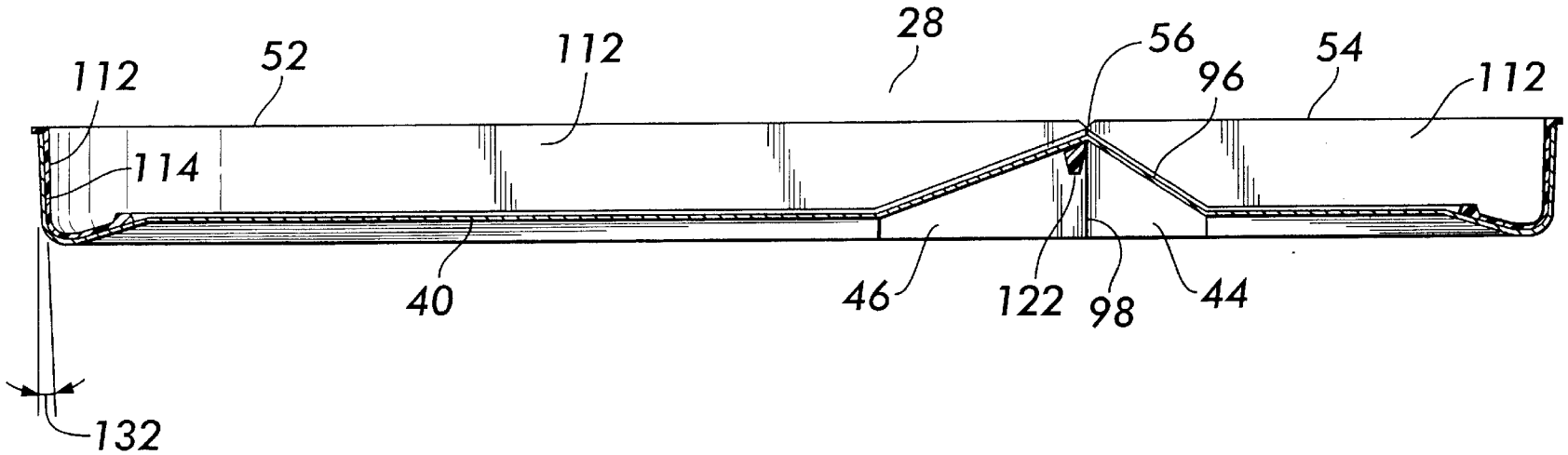
FIG. 7 is a cross-sectional view on an enlarged scale taken along line 7—7 of the lid shown in FIG. 1.

As seen in FIGS. 1 and 7, top 28 is very similar in construction to bottom 26. As seen in FIG. 1, both the movable and fixed parts of the top 28 share a common central panel 40 having a kinked portion 96 disposed between the parts. Kinked portion 96 positions hinge 56 to allow the movable part 54 to be opened and closed and effectively retained in the closed position, as described in detail below.

As noted above, both the movable and fixed parts have respective rim segments 44 and 46 extending around the perimeter 42 of top 28, the rim segments 44 and 46 being separably joined at a relatively weak section 98 adjacent to hinge 56, as seen in FIG. 1. Joining the rim segments 44 and 46 together effectively seals the container adjacent to the hinge while the relatively weak section 98 permits the rim segments 44 and 46 to separate readily and allow rotation of movable part 54 relative to fixed part 52 when the top is opened. Rim segments 44 and 46 extend at an angle to the central panel 40 and each provides a respective surface portion 48 and 50 for attaching top 28 to the inside surface 38 of sidewall 22.

Figure 8:
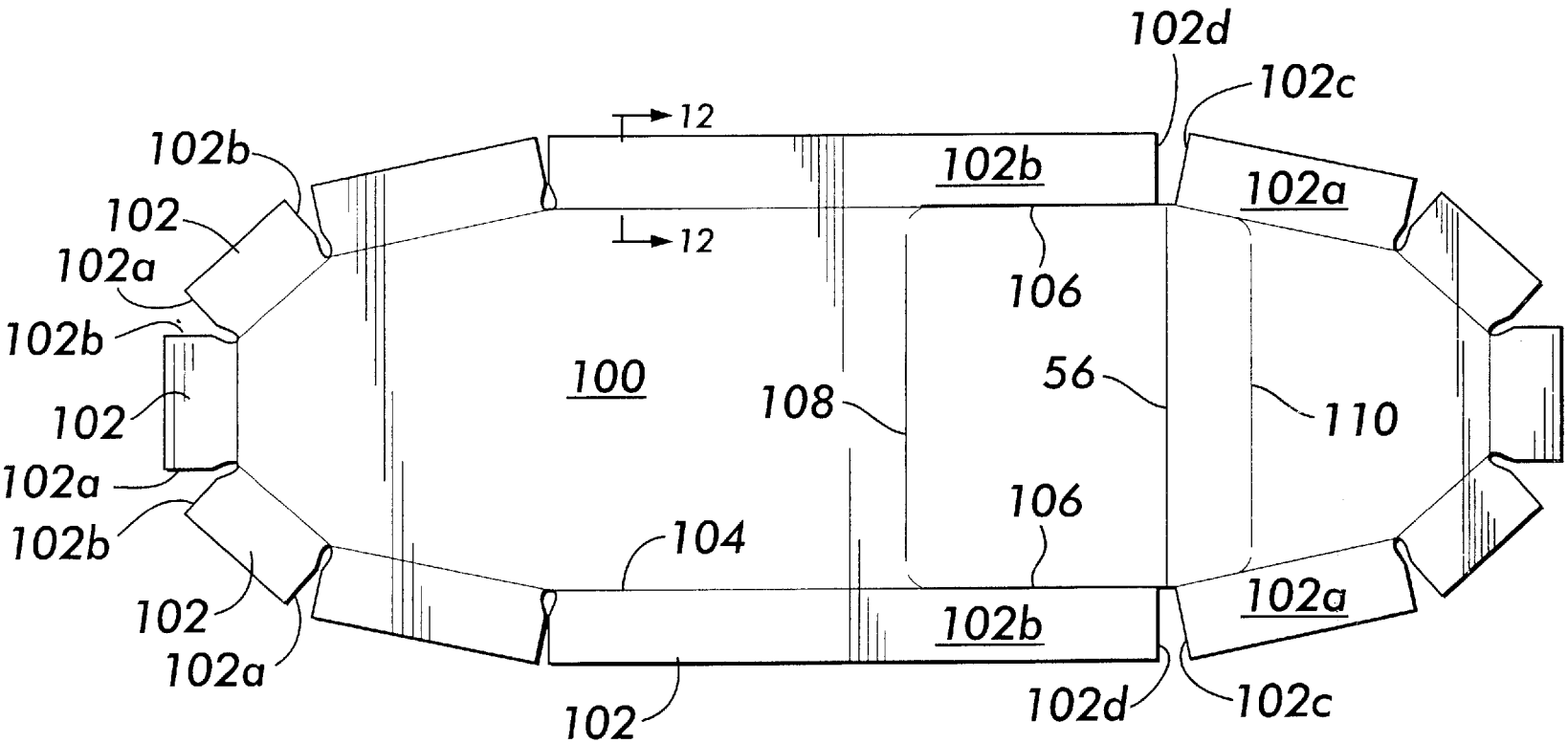
FIG. 8 is a plan view of a unitary blank forming a part of the container top seen in FIG. 1.

Central panel 40 is preferably formed from a unitary blank 100 shown in FIG. 8. Blank 100 has a plurality of secondary panels 102 extending from a perimeter 104, the secondary panels having opposite edge portions 102*a* and 102*b* which are angularly displaced from adjacent edge portions 102*b*, 102*a* respectively, on neighboring secondary panels 102 so that the edges of the secondary panels are in mutual abutment when the secondary panels are folded, as seen in FIGS. 1 and 9, to form the top.

Top 28 differs from bottom 24 mainly due to the hinge 56 and its associate kinked portion 96. Hinge 56 is formed in blank 100 by cutting it along lines 106. Once cut, the kinked portion 96 can be formed by folding the central panel 40 along lines 108, 110 and hinge 56 to position the hinge above the plane of the central panel 40, as best seen in FIGS. 7 and 9.

With the secondary panels 102 in the folded position and the kink portion 96 formed as seen in FIGS. 8 and 9, a skirt 112 is adhered to a surface 114 of the secondary panels facing the center of central panel 40. As seen in FIGS. 1 and 7, skirt 112 extends substantially continuously around the top 28, the skirt and secondary panels 102 forming the rim segments 44 and 46. FIG. 10 shows the rim segment 46 in cross section, the skirt 112 having an upper leg 116 and a lower leg 118 angularly arranged with respect to each other. Upper leg 116 has a flange 120 positioned at its free edge to stiffen the skirt. Flange 120 forms a shoulder 120*a* which abuts against the edge 22*b* of sidewall 22 when the top and sidewall are in interengagement (see FIG. 1). Rim 44 is substantially the same as rim 46 and, therefore, need not be shown in detail. Like the skirt 68 found on the bottom 26, skirt 112 is formed from a plastic resin such as polystyrene, polypropylene or polyethylene to name some examples. Preferably, the skirt 112 is formed and adhered to the secondary panels in an injection molding process as described above.

As seen in FIG. 1, skirt 112 is adhered to the kinked portion 96 to form a completely enclosed container top. As described above, rim segments 44 and 46 are initially continuously joined but are designed to separate at relatively weak section 98 when the container is first opened. Separation of the rim segments at the hinge 56 is ensured by positioning the relatively weak section 98 adjacent to hinge, as seen in FIGS. 1 and 7. Weak section 98 is in overlying registration with particular abutting edges 102*c* and 102*d* of secondary panels 102*a* and 102*b* (see FIGS. 8 and 9) and is formed by perforating or thinning the resin at the section. The weak section 98 is necessary to allow the skirt to separate at the hinge to allow the movable part 54 of the top to rotate into an open position, as seen in FIG. 2. (The secondary panels 102*a* and 102*b* separate naturally at the abutting edges 102*c* and 102*d*.) The hinge 56 is reinforced by a beam 122, best seen in FIG. 7. Beam 122 is positioned on the inside surface of the top parallel and adjacent to hinge 56 on the fixed part 52 of top 28 and is preferably integrally molded of plastic resin along with the skirt 112.

Positioning hinge 56 above the level of central panel 40 ensures that the reclosure of the lid movable part 54 occurs "gover center". Over center engagement is illustrated in FIG. 11 and means that when the top is opened or closed the bottom end 54*a* of movable part 54 sweeps through an arc 124, a portion of which extends beyond the inside surface 38 of sidewall 22. Thus, when movable part 54 is rotated, bottom end 54*a* contacts inside surface 38 of the sidewall and the top and the sidewall deflect elastically to permit the top to swing through arc 124. This requires that some force be applied to the top to open and close it. Over center engagement is advantageous because it insures that, after the container is initially opened and then closed, the top will remain closed until sufficient force is again applied to deflect the top and sidewall, thus, eliminating the need for a separate latching feature to keep the top closed when desired.

As seen in FIG. 10, rim segment 46 is formed with secondary panels 102 positioned with surface portion 50 facing outwardly to engage inside surface 38 of sidewall 22, as seen in FIG. 1. As seen in FIG. 12, the secondary panels 102 of the top comprise a laminate of paperboard 126, metal foil 128 and plastic resin 130 similar to the secondary panels of the bottom. The plastic resin coating layer is positioned outermost on the panel and comprises the attachment surface portions 48 and 50 which contact the inside surface 38 of the sidewall 22. Only the attachment surface 50 is indicated in FIG. 12, it being understood that the configuration shown applies equally well to attachment surface portion 48 of rim segment 44. Foil layer 128 and resin layer 130 allow the top 28 to be adhered to the container by the use of induction heating as described above for the bottom.

Similar to the rim on the bottom, the rim segments 44 and 46 are formed at an angle 132 to the vertical (see FIG. 7), thus, giving a tapered shape to the top in the insertion direction to allow it to easily engage the tube and provide a wedging action to ensure adequate contact between surface portions 48 and 50 and 38 when engaged with the container 20.

While it is desirable that the bottom adhere with equal strength over the entire interface between it and the sidewall, it is desired that attachment surface portion 48 on the movable part 54 of the top adhere less strongly to the sidewall than attachment surface portion 50 on the fixed portion 52. Being the movable part, attachment surface portion 48 must detach from the sidewall without undue force or damage to the container to allow movable part 54 to rotate about hinge 56 and form the dispensing opening 58, as seen in FIG. 2.

FIGS. 13 and 14 illustrate two preferred methods for forming a relatively weak band between the surface portion 48 and the inside surface 38. In FIG. 13, surface portion 48 is provided with a raised region 134 which engages the surface 38 and, thereby, reduces the area of contact between surface portion 48 and inside surface 38 to a fraction of the total surface area of surface portion 48. Reduced contact area means that less force will be required to separate surface portion 48 from surface 38, and since the separation force is proportional to the contact area, the required separation force can be set relatively precisely by precise control of the area of the raised region 134 forming the contact area.

FIG. 14 shows a printed pattern of release agent 136 positioned at an interface between attachment surface portion 48 and sidewall 38. The release agent weakens the bond between surface 48 and inside surface 38 in proportion to the extent of the area of surface 48 covered by the release agent. Again, the separation force can be set to a predetermined level by covering more or less of the surface with the release agent. It is preferred to position the release agent on the metal foil layer 128 between it and adhesive layer 130 (see FIG. 12).

FIG. 15 illustrates another method of attaching movable part 54 to sidewall 22, so that it separates from the sidewall at a lower force than fixed part 52. Inside surface 38 is partially cut with a score line 138 positioned just below the lowermost extent of attachment surface portion 48, the score line preferably being parallel to the edge of the surface portion 48. The cut weakens the attachment between surfaces 48 and 38 by forming a delamination initiation point which allows an inside layer of sidewall 22 to delaminate and break away, thereby, releasing the movable part 54 to rotate into an open position. The force required to open the top can be controlled to some extent by the depth and length of the score line, deeper and longer score lines resulting in lower forces of separation.

FIG. 16 shows another embodiment of a top 200. Similar to the top previously described, top 200 comprises a central panel 202 and peripheral secondary panels 204, preferably of paperboard, a plastic skirt 206 adhered to the secondary and central panels in an injection molding operation and a metal foil layer 208 adhered to the secondary panels 204 opposite plastic skirt 206. A heat-activated adhesive layer 210 is positioned on the metal foil 208. The embodiment of FIG. 16 differs from the previous embodiments in that the heat-activated adhesive layer 210 is a relatively thick coating which is applied after the top 200 is formed. Application of adhesive layer 210 is preferably via a knurled roller which interfaces between a molten reservoir of the adhesive and the foil layer 208. The roller lays down a precisely metered amount of adhesive in liquid form, which is allowed to cool and solidify into the adhesive layer 210.

The top 200 in this form is ready to be installed on a container and can be stored indefinitely and later shipped to a site where containers are being filled. Top 200 provides a tremendous advantage because it can be induction sealed to a container and does not involve the use of liquid adhesives such as hot melt adhesive, with all of their known disadvantages.

Figure 18:
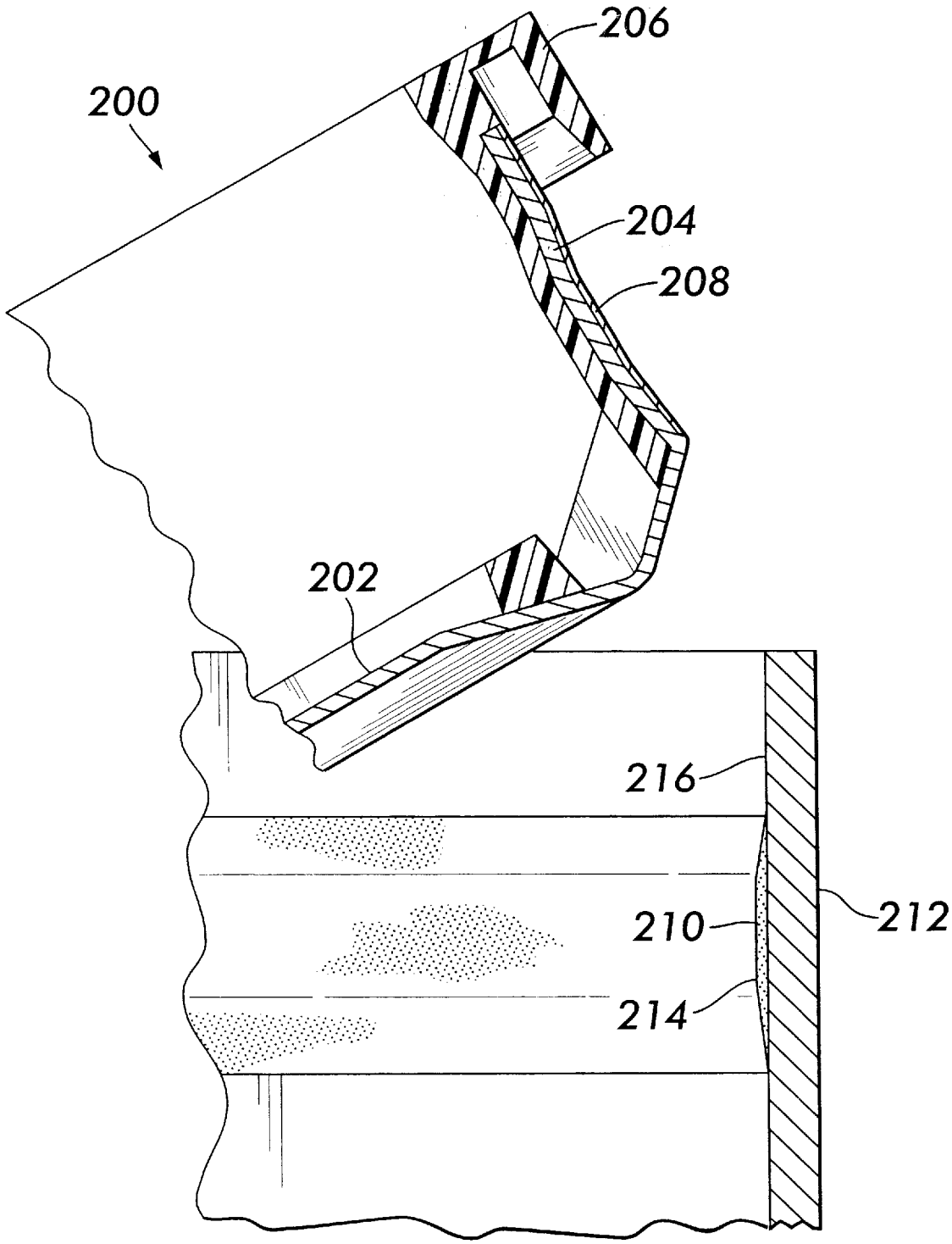
FIG. 18 is a partial sectional view of the container top shown in FIG. 16 in an open position on a container.

As shown in FIG. 17, top 200 is engaged with a container 212, preferably of paperboard, and electromagnetic induction is used to heat the metal foil layer 208 and thereby melt the adhesive layer 210 to bond the top to the container. The amount of adhesive in adhesive layer 210 is precisely controlled to ensure an adequate bond between the container and the top around the entire perimeter of the top without applying too much adhesive, thereby controlling a significant expense in the cost of the top. There is sufficient adhesive present so that, upon melting, it penetrates into the porous paperboard and forms a relatively stronger bond between the adhesive layer 210 and the container 212, than between the adhesive layer and the foil layer 208. Thus, when the top is initially removed from the container, as shown in FIG. 18, the adhesive layer 210 remains substantially with the container 212 due to its relatively greater adhesion to the container. The adhesive layer, thus, forms a raised portion 214 on the interior surface 216 of the container. When the top is reclosed, the raised surface will engage the top 200 and hold it in the closed position via friction and contact forces between the interfacing surfaces, allowing the container to be readily opened and securely closed over and over again.

Figure 19:
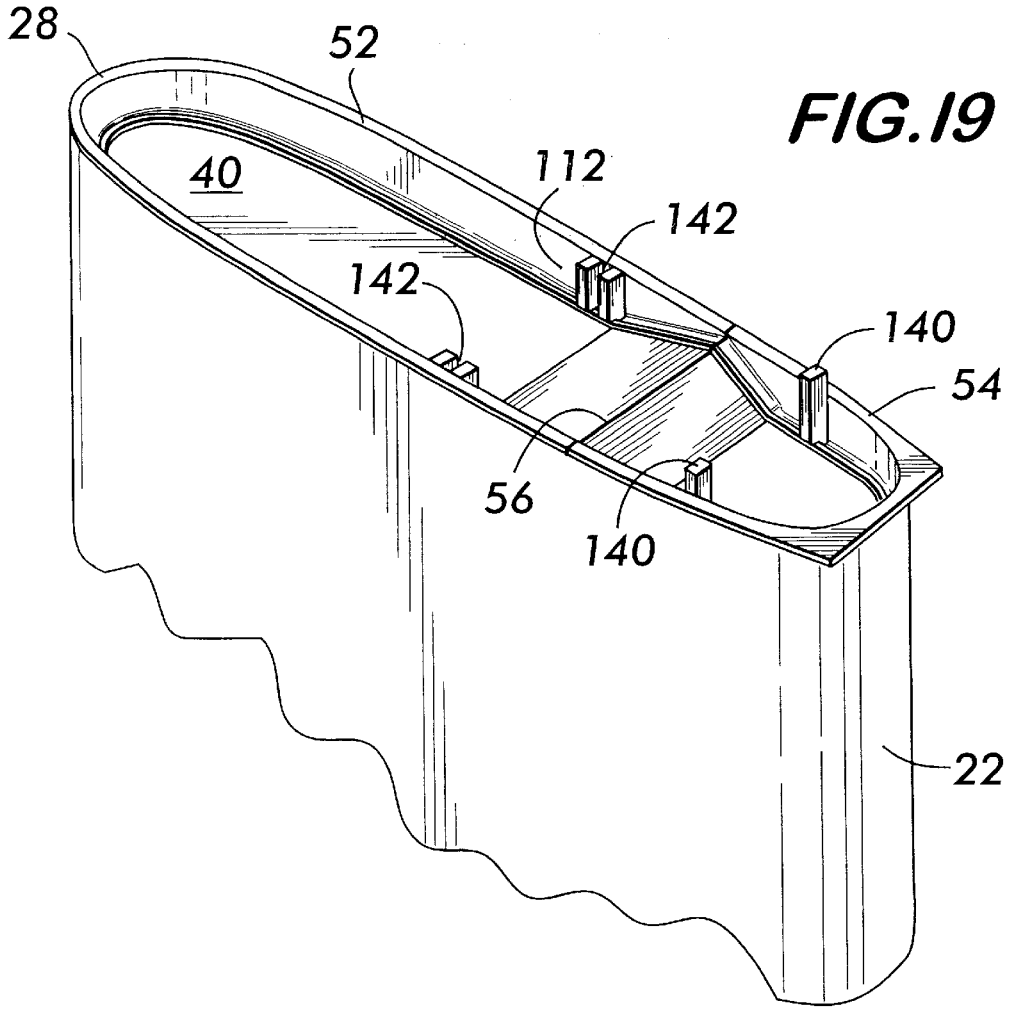
FIG. 19 is a partial rear perspective view of a container having an embodiment of a top according to the invention.
Figure 20:
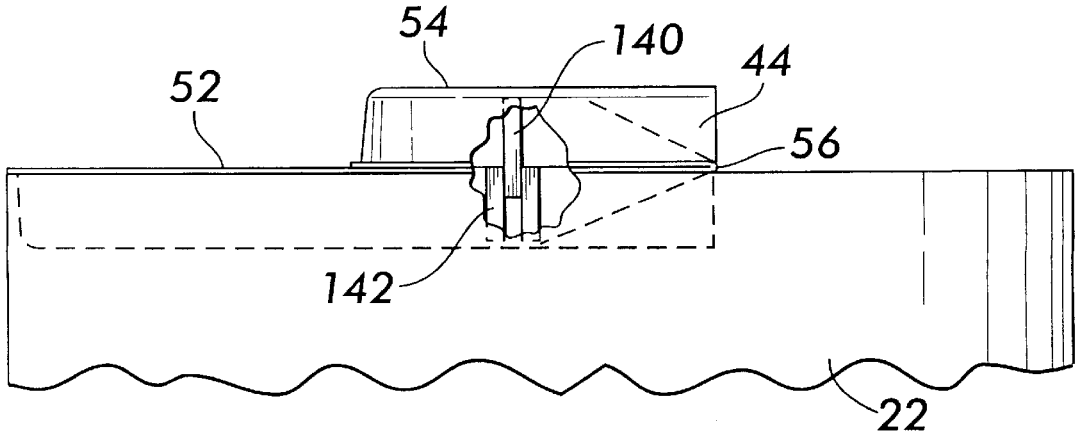
FIG. 20 is a partial side view of the top shown in FIG. 19.

It is sometimes desired to latch the movable part of the top, shown at 54 in FIG. 15, in the open position. FIGS. 19 and 20 illustrate a preferred method for retaining movable part 54 open. Part 54 has a pair of male members 140 which extend from skirt 112 substantially perpendicularly to central panel 40. Male members 140 are on opposite sides of the top 28 and are integrally molded from plastic resin along with the skirt. Fixed part 52 has a pair of female members 142 positioned so as to receive the male members 140 when the movable part 54 is opened and folded fully back in a reverse bend about hinge 56. FIG. 20 shows the movable part positioned when the male and female portions are interengaged. Male members 140 are sized for an interference fit within the female members 142, friction between the two members holding the lid in the open position. Alternately, the engagement of the male and female members could be an over center type engagement, wherein the members must each deflect one another before interengaging and thus latch in the open position by socket action of the male member in the female member, there being required a force sufficient to deflect the members to disengage the members and release the movable part 54 from the open position.

Figure 21:
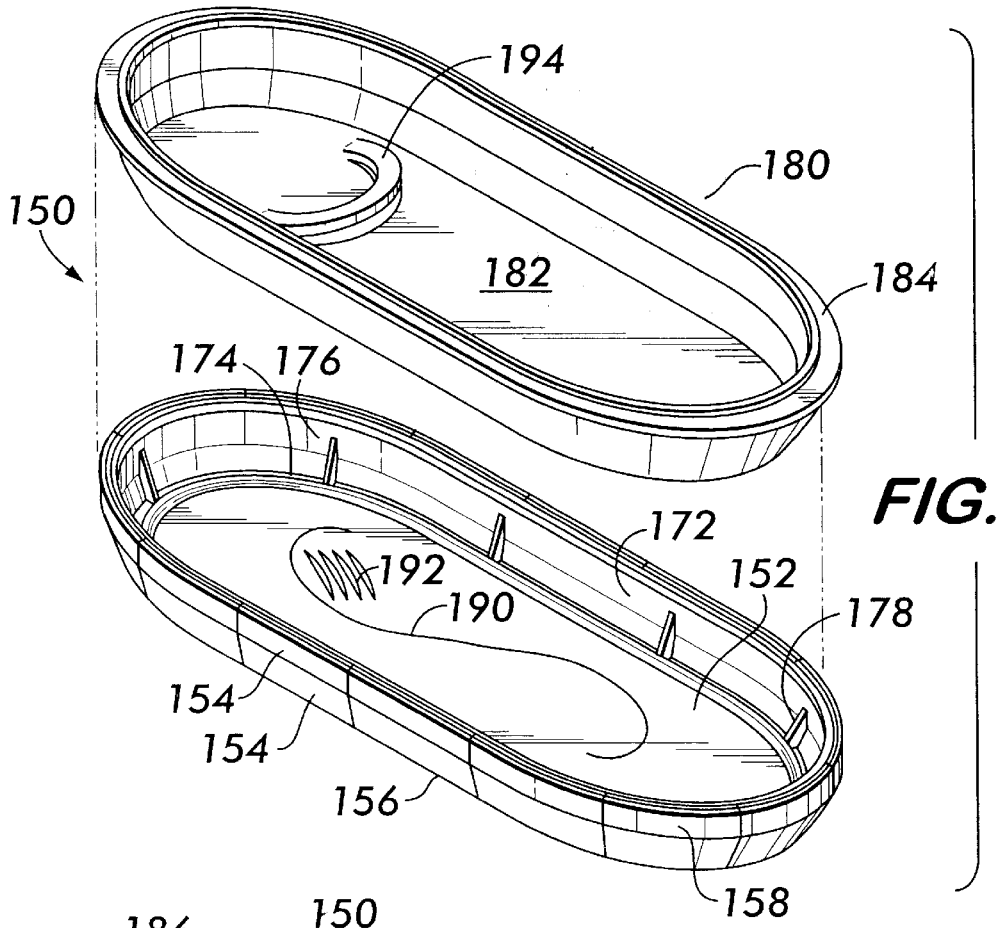
FIG. 21 is an exploded perspective view of a closure having a removable lid according to an alternate embodiment of the invention.
Figure 22:
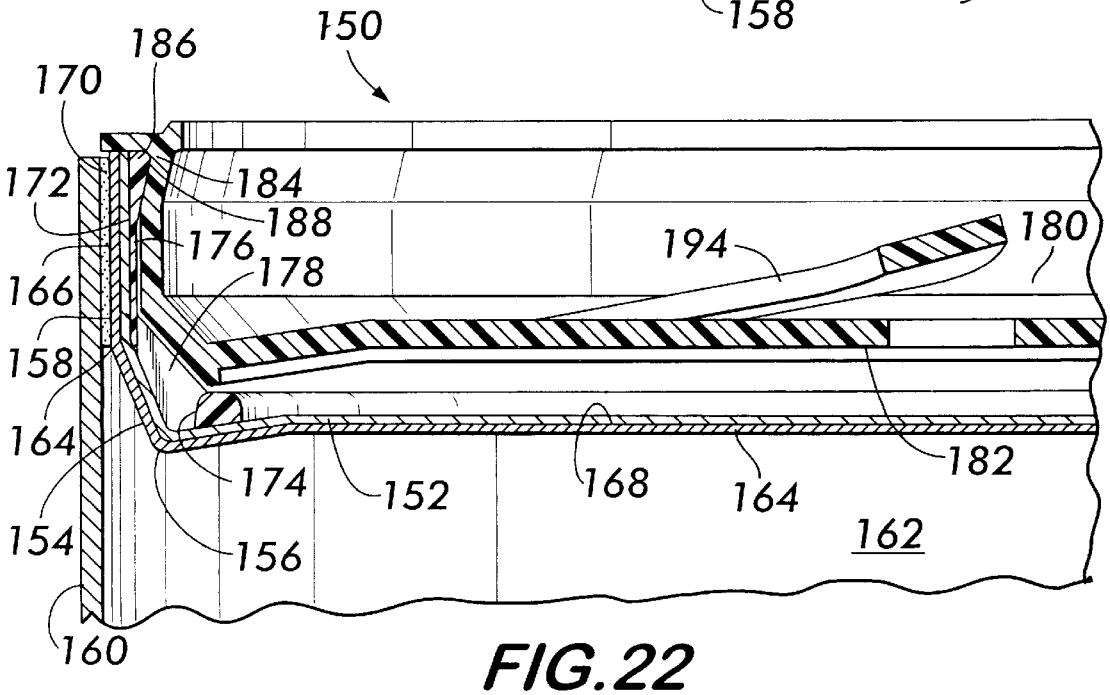
FIG. 22 is a partial sectional view of the lid shown in FIG. 21 engaged with a container.

An alternate embodiment of a closure 150 according to the invention is shown in FIGS. 21 and 22. Closure 150 comprises a central panel 152, preferably of paperboard and having a plurality of secondary panels 154 extending angularly from the perimeter 156 of the central panel. Secondary panels 154 form a surface 158 around the closure substantially parallel to and facing the sidewall 160 of the container 162 (see FIG. 22). A metal foil layer 164 is adhered to the surface 158, the foil layer having a side 166 facing the sidewall. Foil layer 164 is coextensive with the undersurface 168 of central panel 152 and faces the interior of the container. The coextensive foil layer provides an air-tight seal for the container. A heat-activated adhesive layer 170 is positioned on the side 166 of the metal foil layer to form an adhesive bond between the secondary panels 154 and the container sidewall 160, preferably by inductive heating as described in detail above.

Closure 150 also has a plastic skirt 172 extending around the perimeter of central panel 152. Skirt 172 has a lower leg 174 adhered to the central panel and an upper leg 176 adhered to the secondary panels. The skirt may also comprise strengthening ribs 178 positioned in spaced relation circumferentially around the closure between the upper and lower legs.

Closure 150 has a removable lid 180 which has a central surface 182 positionable in overlying relation with central panel 152. Lid 180 has a perimetral flange 184 which extends outwardly from the central surface 182 and engages plastic skirt 172, substantially conforming to the skirt. A rim 186 positioned on skirt 172 defines a shoulder 188 extending inwardly toward the lid, engaging the perimetral flange 184 substantially around the lid and removably retaining the lid to the closure.

Central panel 152 has a cut 190 through the paper layer defining a tab 192 for manually grasping and removing the central panel 152 from the closure for opening the container. The central panel is scored around a circumference inward of the skirt with a cut partially through it to allow the central panel to be easily removed when tab 192 is grasped and pulled upwardly. Other means for removably attaching the central panel, for example, using perforations or nicks at spaced intervals, may also be used.

The container using a closure according to the alternate embodiment may be opened by first removing lid 180. A lifting strap 194 is provided extending from lid 180 to facilitate manual grasping and removal of the lid. Preferably, both the lid 180 and the skirt 172 are comprised of resilient plastic and deflect elastically to allow the perimetral flange 184 to disengage from shoulder 188 on rim 186. Removal of lid 180 exposes central panel 152. Tab 192 is then manually grasped and pulled and the central panel separates from the closure, opening the container 162. Lid 180 may be reinserted into engagement with skirt 172 to reclose the container. The portion of the closure comprising the skirt is attached to and remains with the container sidewall 160 by means of the adhesive bond formed by the adhesive layer 170 when the container is opened and closed.

Container closures according to the invention allow tubular containers to compete on favorable economic terms with other types of containers because they are inductively sealable to the container sidewalls without the need for liquid adhesives or the equipment to apply the adhesives. The closures, furthermore, allow the filling and final sealing steps of a process to be physically separated from the steps of forming the containers, thus, allowing simpler, less expensive machines which do not have to come into contact with the product filling the containers to be used to form the containers.

What is claimed is:

1. A closure for a container having a sidewall defining an interior and an end opening, said closure comprising:

a central panel positionable in registration with said opening, said central panel having a perimeter substantially conforming to said sidewall;

at least one secondary panel attached directly to said central panel at said perimeter and extending angularly therefrom and forming a surface around said closure substantially conforming to and facing said sidewall, a first portion of said surface being removably attachable to said sidewall and a second portion of said surface being fixedly attachable to said sidewall, said first surface portion defining a movable part of said closure separable from engagement with said sidewall and movable with respect to said container, said second surface portion defining a fixed part of said closure fixable to said sidewall;

a metal foil layer adhered to said surface of said secondary panel, said metal foil layer having a side facing said sidewall;

a heat-activated adhesive layer positioned on said side of said metal foil layer and engageable with said sidewall, said metal foil layer being heatable by electromagnetic induction to melt said heat-activated adhesive layer thereon and form an adhesive bond between said secondary panel and said sidewall when said secondary panel and said sidewall are in interfacing relationship, said adhesive bond between said first surface portion and said sidewall being a relatively weaker bond than said adhesive bond between said second surface portion and said sidewall; and a hinge positioned on said central panel between said fixed and said movable parts of said closure, said movable part being pivotable on said hinge relatively to said fixed part into a position away from said opening when said closure is positioned in registration with said opening.

2. A closure according to claim 1, wherein said surface faces outwardly from said central panel and is engageable with said sidewall within said interior of said container.

3. A closure according to claim 2, further comprising a plastic skirt extending around said perimeter of said central panel, said skirt having an upper leg adhered to said central panel, and a lower leg adhered to said secondary panel on a side opposite to said heat-activated adhesive layer.

4. A closure according to claim 3, wherein said central panel and said secondary panel comprise paperboard.

5. A closure according to claim 4, wherein said central panel has a cut therethrough defining a tab for manually grasping and removing said central panel from said closure.

6. A closure according to claim 3, wherein said heat-activated adhesive layer is applied to said closure in liquid form and allowed to solidify.

7. A closure according to claim 3, wherein said skirt comprises a pair of relatively weaker regions positioned adjacent to said hinge between said fixed and movable parts on opposite sides of said closure, said skirt being separable at said relatively weaker regions when said movable part is pivoted relatively to said fixed part.

8. A closure according to claim 1, wherein said metal foil layer comprises aluminum.

9. A closure according to claim 1, wherein said heat-activated adhesive layer comprises a plastic resin.

10. A closure according to claim 1, wherein said adhesive bond between said first surface portion and said sidewall has relatively greater adhesion to said sidewall than to said closure, adhesive forming said adhesive bond substantially remaining on said sidewall when said movable part of said closure is pivoted into said position away from said opening.

11. A closure according to claim 1, further comprising an adhesive release agent positionable at an interface between said first surface portion and said sidewall for forming said relatively weaker adhesive bond.

12. A closure according to claim 11, wherein said adhesive release agent is positioned at an interface between said adhesive layer and said foil layer.

13. A closure according to claim 1, wherein said hinge comprises a fold line arranged on said central panel and extending across said closure.

14. A closure according to claim 1, wherein said metal foil layer is coextensive with a surface of said central panel facing the interior of said container.

15. A container comprising:

a sidewall defining an interior space and an opening;

a closure comprising:

a central panel positioned in registration with said opening and having a perimeter substantially conforming to said sidewall;

a plurality of secondary panels each attached directly to said central panel at said perimeter and extending angularly therefrom and forming a surface around said perimeter and facing said sidewall, a first portion of said surface being removably attached to said sidewall and a second portion of said surface being fixedly attached to said side wall, said first surface portion defining a movable part of said closure separable from engagement from said sidewall and movable with respect to said container, said second surface portion defining a fixed part of said closure fixed to said sidewall;

a metal foil layer positioned between said surface and said sidewall, said metal foil layer being adhered to said surface;

an adhesive bond between said metal foil layer and said sidewall joining said central panel to said container, said adhesive bond formed by a heat-activated adhesive layer heated by eddy currents within said metal foil layer caused by electromagnetic induction, said adhesive bond between said first surface portion and said sidewall being a relatively weaker bond than said adhesive bond between said second surface portion and said sidewall; and a hinge positioned on said central panel between said fixed and said movable parts of said closure, said movable part being pivotable on said hinge relatively to said fixed part into a position away from and exposing said opening.

16. A container according to claim 15, further comprising a plastic skirt extending around said perimeter of said central panel, said skirt having an upper leg adhered to said central panel and a lower leg adhered to said secondary panels on a side opposite to said surface.

17. A container according to claim 16, wherein said sidewall, said central panel and said secondary panels comprise paperboard.

18. A container according to claim 16, wherein said skirt comprises a pair of relatively weaker regions positioned adjacent to said hinge between said fixed and movable parts on opposite sides of said container, said skirt being separable at said weaker regions when said movable part is pivoted relatively to said fixed part.

19. A container according to claim 16, further comprising:

a cut through said central panel defining a tab for manually grasping and removing said central panel from said container;

a removable lid having a central surface in overlying relation with said central panel, said lid having a perimetral flange extending angularly outwardly from said central surface around said lid and conforming substantially to said skirt; and a rim positioned on said skirt surrounding said central panel, said rim defining a shoulder extending inwardly toward said lid and engaging said perimetral flange substantially around said lid for removably retaining said lid to said closure.

20. A container according to claim 15, wherein said first surface portion comprises a raised region projecting above said surface toward said sidewall, said raised region having a surface area comprising a fraction of said first surface portion, said relatively weaker adhesive bond being formed between said foil layer covering said raised region and said sidewall.

* * * * *